US009469966B2

(12) United States Patent
Abe et al.

(10) Patent No.: US 9,469,966 B2
(45) Date of Patent: Oct. 18, 2016

(54) GUARD-EQUIPPED CAB FOR WORK VEHICLE AND HYDRAULIC EXCAVATOR

(71) Applicant: KOMATSU LTD., Tokyo (JP)

(72) Inventors: Hiroshi Abe, Hirakata (JP); Makoto Sasaki, Takatsuki (JP)

(73) Assignee: KOMATSU LTD., Tokyo (JP)

( * ) Notice: Subject to any disclaimer, the term of this patent is extended or adjusted under 35 U.S.C. 154(b) by 66 days.

(21) Appl. No.: 14/422,225

(22) PCT Filed: Dec. 11, 2014

(86) PCT No.: PCT/JP2014/082785

§ 371 (c)(1),
(2) Date: Feb. 18, 2015

(87) PCT Pub. No.: WO2015/087951

PCT Pub. Date: Jun. 18, 2015

(65) Prior Publication Data

US 2016/0168823 A1 Jun. 16, 2016

(51) Int. Cl.

| | |
|---|---|
| ***E02F 9/16*** | (2006.01) |
| ***E02F 9/24*** | (2006.01) |
| ***E02F 3/32*** | (2006.01) |

(52) U.S. Cl.

CPC ..... *E02F 9/163* (2013.01); *E02F 3/32* (2013.01); *E02F 9/24* (2013.01)

(58) Field of Classification Search

CPC ..... E02F 9/163
USPC ..... 296/190.03; 280/756
See application file for complete search history.

(56) References Cited

U.S. PATENT DOCUMENTS

| | | | | |
|---|---|---|---|---|
| 9,151,016 | B2 * | 10/2015 | Sasaki | B60R 21/11 |
| 2003/0111281 | A1 * | 6/2003 | Jo | B60R 21/11 180/89.13 |
| 2014/0292032 | A1 | 10/2014 | Sasaki et al. | |
| 2015/0123428 | A1 * | 5/2015 | Hwang | B62D 33/06 296/190.03 |
| 2016/0168824 | A1 * | 6/2016 | Abe | E02F 9/163 296/190.03 |

FOREIGN PATENT DOCUMENTS

| | | | |
|---|---|---|---|
| CN | 203766693 | U | 8/2014 |
| JP | H08-177082 | A | 7/1996 |
| JP | 2001-097250 | A | 4/2001 |
| JP | 2011-084876 | A | 4/2011 |
| JP | 2013-170446 | A | 9/2013 |
| JP | 5355831 | B1 | 11/2013 |
| JP | 2014-054942 | A | 3/2014 |

* cited by examiner

*Primary Examiner* — Jason S Morrow
(74) *Attorney, Agent, or Firm* — Drinker Biddle & Reath LLP

(57) ABSTRACT

Provided is a guard-equipped cab for a work vehicle in which contact between a work implement and a member for coupling an operator protective guard to a cab can be avoided. A front guard is coupled by hinges to be openable/closable with respect to a cab for a work vehicle. A hinge has a shaft portion, a first plate member, and a second plate member. The first plate member is fixed with respect to a right front pillar. The second plate member is fixed with respect to the front guard. The first plate member has a support portion supporting the shaft portion, and extends from the support portion toward a left surface of the cab for the work vehicle.

9 Claims, 5 Drawing Sheets

GUARD-EQUIPPED CAB FOR WORK VEHICLE AND HYDRAULIC EXCAVATOR

TECHNICAL FIELD

The present invention relates to a guard-equipped cab for a work vehicle and a hydraulic excavator.

BACKGROUND ART

A work vehicle such as a hydraulic excavator or a scrap loader includes a cab in which an operator operating the work vehicle rides. The cab is equipped with an operator protective guard for appropriately protecting the operator against vandals flying from the front of or above the cab to the cab.

Japanese Patent Laying-Open No. 2011-84876 (PTD 1) discloses a configuration in which a front guard is coupled to a right side surface of a front pillar of a cab via hinges. Japanese Patent Laying-Open No. 2013-170446 (PTD 2) discloses a configuration in which a front guard is coupled to a front pillar of a cab via hinges and two brackets.

CITATION LIST

Patent Document

PTD 1: Japanese Patent Laying-Open No. 2011-84876
PTD 2: Japanese Patent Laying-Open No. 2013170446

SUMMARY OF INVENTION

Technical Problem

In a work vehicle in which a cab is arranged on a lateral side of a work implement, if a member for coupling an operator protective guard to the cab protrudes from a side surface of the cab toward the work implement, the protruding member may come into contact with the work implement.

One object of the present invention is to provide a guard-equipped cab for a work vehicle in which contact between a work implement and a member for coupling an operator protective guard to a cab can be avoided, and a hydraulic excavator including the guard-equipped cab for the work vehicle.

Solution to Problem

A guard-equipped cab for a work vehicle in accordance with the present invention includes a cab in which an operator operating a work vehicle rides, an operator protective guard provided on a front side of the cab, and a hinge which couples the operator protective guard to be openable/closable with respect to the cab. The cab includes one side surface, another side surface, and a front pillar provided on a side of the one side surface. The hinge includes a shaft portion, a first plate member, and a second plate member. The first plate member is fixed with respect to the front pillar. The first plate member includes a support portion supporting the shaft portion. The first plate member extends from the support portion toward the other side surface. The second plate member is fixed with respect to the operator protective guard. The second plate member relatively rotates with respect to the first plate member, about the shaft portion.

In the above work vehicle, in a state where the operator protective guard is closed with respect to the cab, the first plate member and the second plate member form an acute angle, as viewed in a plan view.

In the above work vehicle, an angle formed by the first plate member and the second plate member in a state where the operator protective guard is opened with respect to the cab, as viewed in a plan view, is larger than an angle formed by the first plate member and the second plate member in a state where the operator protective guard is closed with respect to the cab, as viewed in a plan view.

The above work vehicle includes a bracket mounted on a front surface of the front pillar. The first plate member is mounted on the bracket.

The above work vehicle includes a plurality of the hinges. The bracket extends along the front pillar. The plurality of the hinges are mounted on the bracket to be spaced from each other in a direction in which the bracket extends.

In the above work vehicle, the cab includes a front windshield, and a cleaning device cleaning the front windshield. At least a portion of the cleaning device is housed within a space defined by the bracket and the front pillar.

In the above work vehicle, the operator protective guard includes a vertical frame which constitutes an outer edge of the operator protective guard and is coupled to the hinge. The vertical frame is formed of a tubular material.

In the above work vehicle, in a state where the operator protective guard is closed with respect to the cab, the first plate member is arranged to be inclined with respect to a front surface of the front pillar, and the second plate member extends in a front-rear direction of the cab.

A hydraulic excavator in accordance with the present invention includes a work implement, and any guard-equipped cab for a work vehicle described above.

In the above hydraulic excavator, the guard-equipped cab for the work vehicle is arranged on a lateral side of the work implement, and the front pillar faces the work implement.

Advantageous Effects of Invention

According to the present invention, contact between a work implement and a hinge for coupling an operator protective guard to a cab can be avoided.

DESCRIPTION OF EMBODIMENTS

Hereinafter, an embodiment of the present invention will be described with reference to the drawings.

First, a configuration of a work vehicle in one embodiment of the present invention will be described. Although a hydraulic excavator as one example of a work vehicle to which the concept of the present invention is applicable will be described below, the present invention is applicable to a work vehicle including a cab for the work vehicle.

Figure 1:
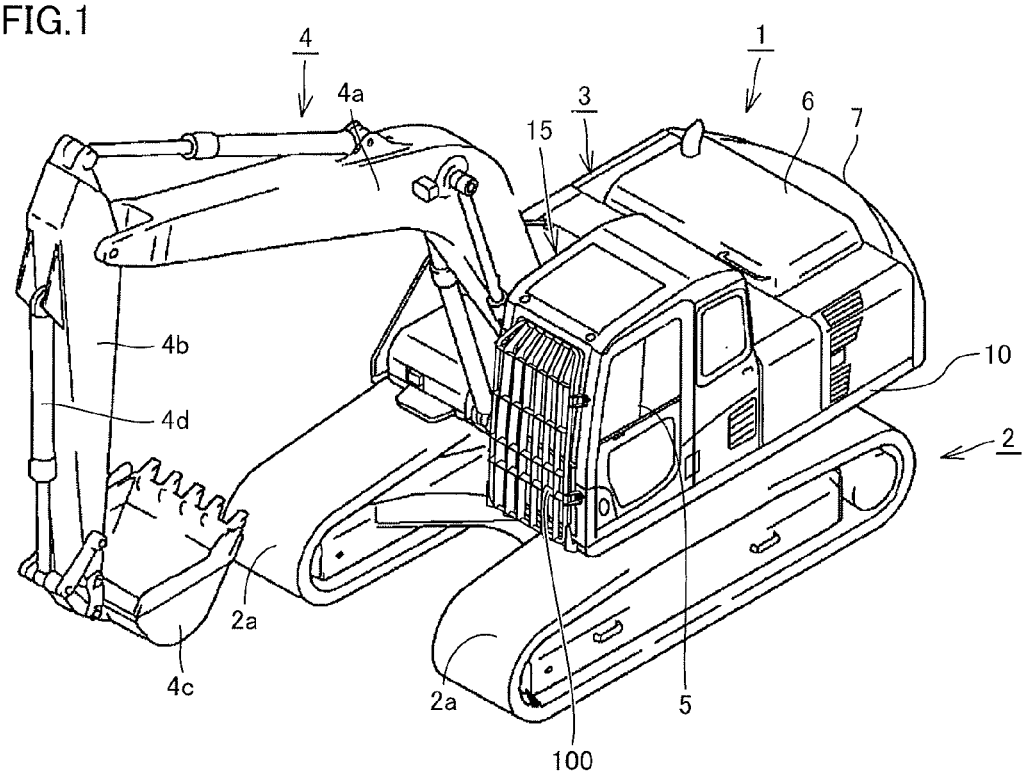
FIG. 1 is a perspective view schematically showing a configuration of a work vehicle in an embodiment of the present invention.

FIG. 1 is a perspective view schematically showing a configuration of a hydraulic excavator 1 as a work vehicle in an embodiment of the present invention. As shown in FIG. 1, hydraulic excavator 1 mainly includes a travel structure 2, a revolving structure 3, a work implement 4, and a guard-equipped cab 15 for the work vehicle. Travel structure 2 and revolving structure 3 mainly constitute a main body of the work vehicle.

Travel structure 2 has a pair of right and left crawler belts 2*a*. Travel structure 2 is configured to allow self-propelling by rotating the pair of crawler belts 2*a*. Revolving structure 3 is mounted revolvably with respect to travel structure 2.

Revolving structure 3 has a cab 5 for the work vehicle as a space for an operator to operate hydraulic excavator 1, on a front left side. Revolving structure 3 has an engine compartment 6 accommodating an engine, and a counterweight 7, on a rear side. it is noted that, in the present embodiment, with the operator sitting inside cab 5 for the work vehicle, a front side of the operator is defined as a front side of revolving structure 3, a side opposite to the front side, that is, a rear side of the operator, is defined as a rear side of revolving structure 3, a left side of the sitting operator is defined as a left side of revolving structure 3, and a right side of the sitting operator is defined as a right side of revolving structure 3. It is hereinafter assumed that the front, rear, left, and right of revolving structure 3 correspond to the front, rear, left, and right of the work vehicle.

Revolving structure 3 has a revolving frame 10. Revolving frame 10 is included in the main body of the work vehicle. Revolving frame 10 is arranged above travel structure 2, and is provided to be revolvable in an arbitrary direction with respect to travel structure 2. Work implement 4, guard-equipped cab 15 for the work vehicle, and counterweight 7 are mounted on revolving frame 10 and arranged on an upper surface of revolving frame 10.

Work implement 4 for performing work such as soil excavation is pivotally supported by revolving structure 3 to be operable in an up-down direction. Work implement 4 has a boom 4*a* mounted to a substantially central portion of the front side of revolving structure 3 to be operable upward/downward, an arm 4*b* mounted to a distal end portion of boom 4*a* to be operable forward/rearward, and a bucket 4*c* mounted to a distal end portion of arm 4*b* to be operable forward/rearward. Boom 4*a*, arm 4*b*, and bucket 4*c* are each configured to be actuated by hydraulic cylinders 4*d*.

Guard-equipped cab 15 for the work vehicle is arranged on the front left side of revolving structure 3. Work implement 4 is provided on the right side with respect to guard-equipped cab 15 for the work vehicle, which is one of the lateral sides of guard-equipped cab 15 for the work vehicle.

Figure 2:
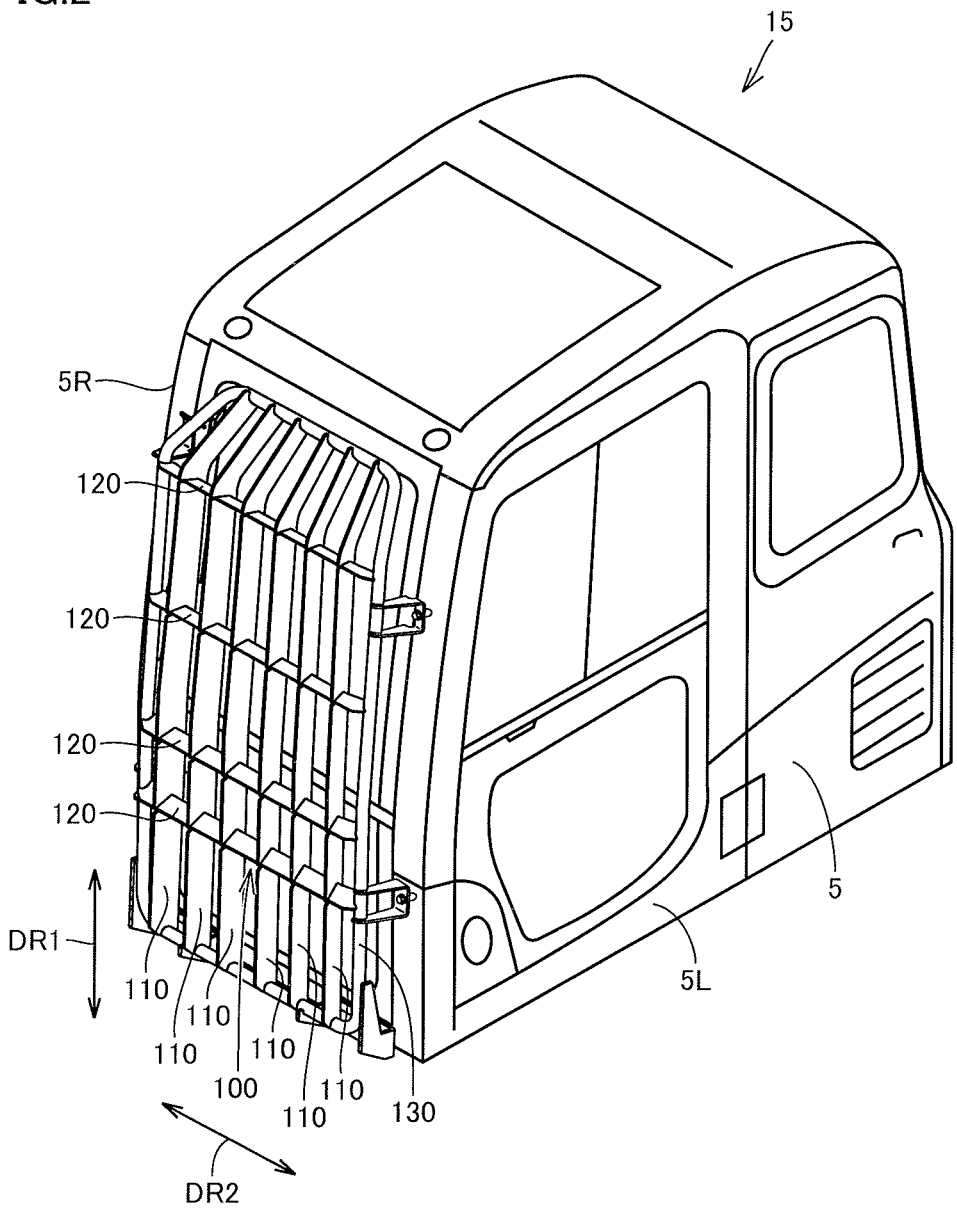
FIG. 2 is a perspective view schematically showing a configuration of a guard-equipped cab for the work vehicle in the embodiment of the present invention.

FIG. 2 is a perspective view schematically showing a configuration of guard-equipped cab 15 for the work vehicle in the embodiment of the present invention. As shown in FIG. 2, guard-equipped cab 15 for the work vehicle has cab 5 for the work vehicle in which the operator operating hydraulic excavator 1 rides, and an operator protective guard for protecting the operator riding in cab 5 for the work vehicle. The operator protective guard includes a front guard 100. Front guard 100 is mounted on cab 5 for the work vehicle. Front guard 100 is provided on a front side of cab 5 for the work vehicle for the purpose of protecting the operator against flying vandals from the front of cab 5 for the work vehicle.

Front guard 100 includes a plurality of first plate members 110 and a plurality of second plate members 120. Each first plate member 110 is formed of one plate. Each second plate member 120 is formed of one plate. Front guard 100 has a configuration in which the plurality of first plate members 110 and the plurality of second plate members 120 are assembled in a grid pattern such that a longitudinal direction DR1 (of each of the plurality of first plate members 110 intersects with a longitudinal direction DR2 of each of the plurality of second plate members 120.

A frame 130 as a frame body is provided to surround a grid formed by the plurality of first plate members 110 and the plurality of second plate members 120. The periphery of the grid is supported by frame 130. Front guard 100 includes frame 130 surrounding the plurality of first plate members 110 and the plurality of second plate members 120 assembled in the grid pattern. Frame 130 constitutes an outer edge of front guard 100. Frame 130 is formed by bending and deforming a pipe into a predetermined shape and coupling the pipe to each other as appropriate. The plurality of first plate members 110 and the plurality of second plate members 120 are mounted on a surface on the front side of cab 5 for the work vehicle, with frame 130 interposed therebetween.

Cab 5 for the work vehicle has a right surface 5R and a left surface 5L. Right surface 5R is one side surface of cab 5 for the work vehicle. Left surface 5L is another side surface of cab 5 for the work vehicle. Right surface 5R and left surface 5L form a pair of side surfaces of cab 5 for the work vehicle. Work implement 4 shown in FIG. 1 faces right surface 5R of cab 5 for the work vehicle.

Figure 3:
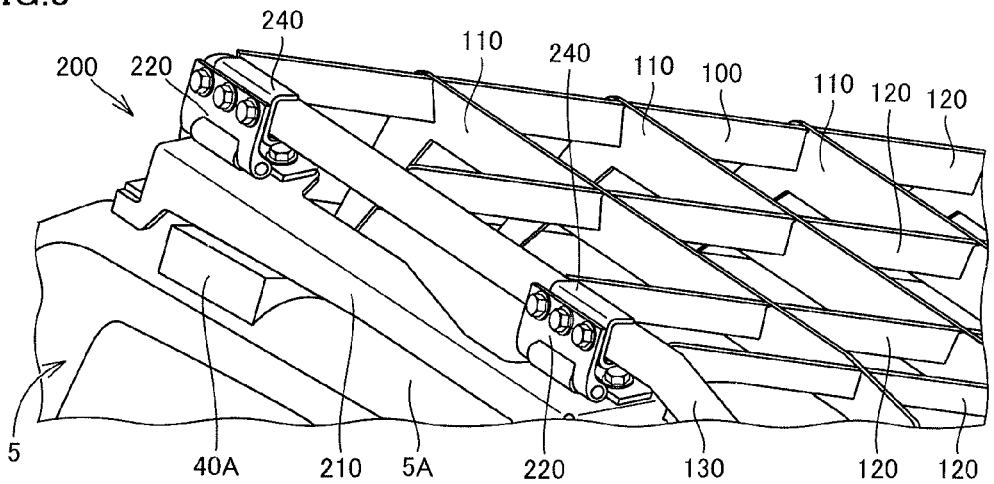
FIG. 3 is a perspective view of a coupling portion which couples a front guard to the cab for the work vehicle.

FIG. 3 is a perspective view of a coupling portion 200 which couples front guard 100 to cab 5 for the work vehicle. As shown in FIG. 3, cab 5 for the work vehicle has a right front pillar 5A. Right front pillar 5A is a right-side front pillar of a pair of front pillars arranged at a front surface of cab 5 for the work vehicle. Right front pillar 5A is provided on the side of right surface 5R of cab 5 for the work vehicle. Also referring to FIG. 1, right front pillar 5A faces work implement 4. Coupling portion 200 which couples front guard 100 to cab 5 for the work vehicle is provided to right front pillar 5A which is closer to work implement 4 (FIG. 1) of the pair of front pillars.

Coupling portion 200 has a bracket 210 and hinges 220. Bracket 210 is mounted on a front surface of right front pillar 5A, at upper and lower ends of bracket 210. Bracket 210 extends along right front pillar 5A. Two hinges 220 are mounted on one bracket 210. Coupling portion 200 has two hinges 220. As shown in FIG. 3, two hinges 220, 220 are mounted on bracket 210 to be spaced from each other in a direction in which bracket 210 extends.

Front guard 100 is mounted on cab 5 for the work vehicle with bracket 210 and hinges 220 interposed therebetween. Hinges 220 couple front guard 100 to be openable/closable with respect to cab 5 for the work vehicle. Front guard 100 is provided to be able to relatively rotate with respect to cab 5 for the work vehicle, about hinges 220.

Figure 4:
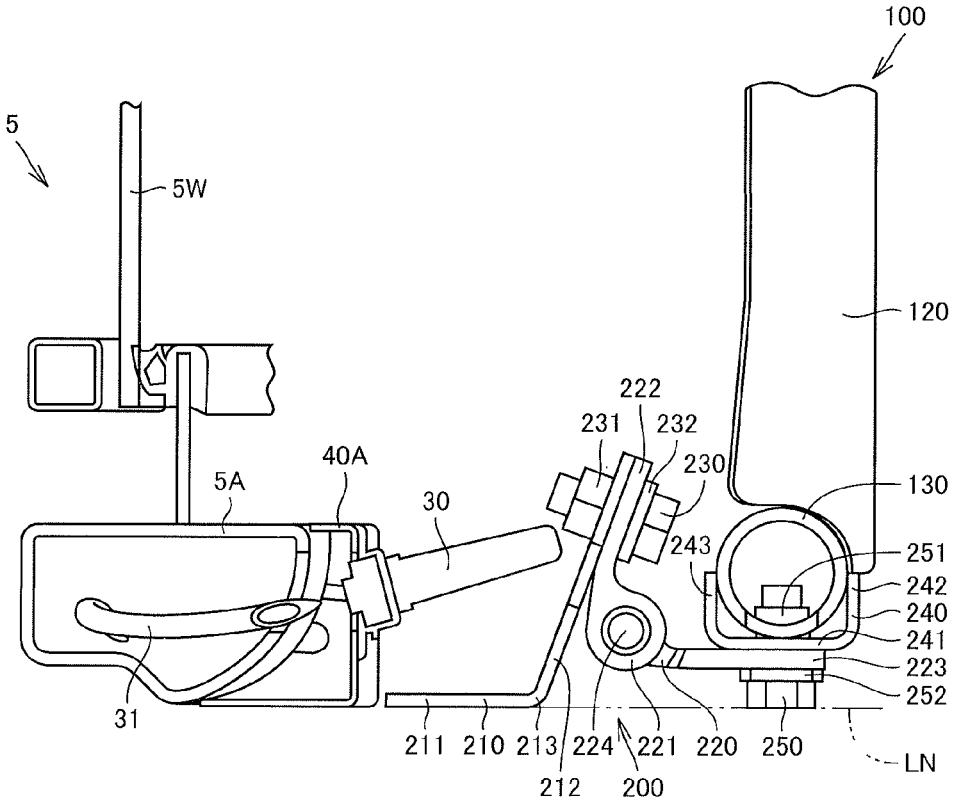
FIG. 4 is a first cross sectional view showing details of a configuration of the coupling portion shown in FIG. 3.

FIG. 4 is a first cross sectional view showing details of a configuration of coupling portion 200 shown in FIG. 3. FIG. 4 shows a cross section of coupling portion 200 taken along a horizontal direction at a position where hinge 220 is arranged, as viewed from above.

As shown in FIG. 4, bracket 210 has plate portions 211, 212. Plate portions 211, 212 each have the shape of an elongate plate. Plate portions 211, 212 are joined at a joining portion 213. A long side of plate portion 211 and a long side of plate portion 212 are joined at joining portion 213. In the cross sectional view shown in FIG. 4, bracket 210 has a shape in which a plate material is bent at joining portion 213, as a whole.

Plate portion 211 extends in a front-rear direction of cab 5 for the work vehicle (a left-right direction in FIG. 4). Plate portion 211 extends along right surface 5R (FIG. 2) of cab 5 for the work vehicle. A chain double-dashed line LN in FIG. 4 indicates a virtual extension line of right surface 5R of cab 5 for the work vehicle. Plate portion 211 is arranged so as not to protrude outward from right surface 5R of cab 5 for the work vehicle.

Plate portion 212 extends to intersect with a direction in which plate portion 211 extends (the front-rear direction of cab 5 for the work vehicle). The direction in which plate portion 211 extends and a direction in which plate portion 212 extends form an obtuse angle. Plate portion 212 shown in FIG. 4 has one end joined to plate portion 211, and another end opposite to the one end. Plate portion 212 is arranged such that the other end is farther from right front pillar 5A, and is farther from right surface 5R of cab 5 for the work vehicle, than the one end joined to plate portion 211.

Plate portion 212 is arranged to be spaced from the front surface of right front pillar 5A. A space is formed between plate portion 212 and the front surface of right front pillar 5A. In this space, a washer fluid nozzle 30 and a cleaning device base 40A are provided. Washer fluid nozzle 30 is mounted on cleaning device base 40A. Cleaning device base 40A is mounted on the front surface of right front pillar 5A. Right front pillar 5A is formed to be hollow, and a washer fluid hose 31 is arranged in an internal space of right front pillar 5A. Washer fluid hose 31 is connected to washer fluid nozzle 30.

Cab 5 for the work vehicle has a front windshield 5W between right front pillar 5A shown in FIG. 4 and a left front pillar not shown. Front windshield 5W is provided at the front surface of cab 5 for the work vehicle. Front windshield 5W is formed of a transparent material. The operator sitting inside cab 5 for the work vehicle can see the outside in front of cab 5 for the work vehicle, through front windshield 5W.

A washer fluid is supplied to washer fluid nozzle 30 through washer fluid hose 31. The washer fluid is sprayed onto front windshield 5W from washer fluid nozzle 30, and thereby front windshield 5W is cleaned. Washer fluid nozzle 30 is included in a cleaning device for cleaning front windshield 5W. Washer fluid nozzle 30 is housed within the space between right front pillar 5A and plate portion 212 of bracket 210.

Hinge 220 has a first plate member 222, a second plate member 223, and a shaft portion 224. Shaft portion 224 has the shape of a solid cylinder.

First plate member 222 has a plate-like portion and a support portion 221. Support portion 221 supports shaft portion 224. Support portion 221 is provided at one end of first plate member 111. One end of the plate-like portion of first plate member 222 is coupled to support portion 221. Support portion 221 has a portion formed in the shape of a hollow cylinder. Shaft portion 224 is housed in an internal space of cylindrical support portion 221. The plate-like portion and support portion 221 of first plate member 222 are integrally formed. Shaft portion 224 is formed as a member which is distinct from first plate member 222.

Second plate member 223 has a plate-like portion and a support portion. The support portion supports shaft portion 224. The support portion is provided at one end of second plate member 223. One end of the plate-like portion of second plate member 223 is coupled to the support portion. The plate-like portion and the support portion of second plate member 223 are integrally formed. The support portion of second plate member 223 has a portion formed in the shape of a hollow cylinder. Shaft portion 224 is housed in an internal space of the cylindrical support portion. Alternatively, an end portion of shaft portion 224 in an axis direction (a direction perpendicular to a paper plane in FIG. 4) may be coupled to the support portion of second plate member 223. Shaft portion 224 may be formed as a member which is distinct from the second plate member, or may be formed integrally with second plate member 223.

Support portion 221 of first plate member 222 and the support portion of second plate member 223 are arranged at positions where they overlap with each other as viewed in an axis direction of cylindrical support portion 221 (the direction perpendicular to the paper plane in FIG. 4). Support portion 221 of first plate member 222, the support portion of second plate member 223, and shaft portion 224 housed in support portion 221 are arranged at positions where they overlap with right front pillar 5A when cab 5 for the work vehicle is viewed from front.

First plate member 222 extends leftward with respect to shaft portion 224 in a left-right direction of cab 5 for the work vehicle. First plate member 222 extends from support portion 221 toward left surface 5L of cab 5 for the work vehicle. First plate member 222 extends in a direction from right surface 5R toward left surface 5L of cab 5 for the work vehicle, with respect to shaft portion 224.

First plate member 222 has a through-hole formed to penetrate first plate member 222 in a thickness direction. Plate portion 212 of bracket 210 has a through-hole formed to penetrate plate portion 212 in a thickness direction. A bolt 230 is arranged to penetrate these through-holes. Bolt 230 is screwed into a nut 231. A washer 232 is arranged between the head of bolt 230 and first plate member 222.

First plate member 222 and plate portion 212 are sandwiched between the head of bolt 230 plus washer 232 and nut 231. Thereby, first plate member 222 and plate portion 212 are fixed to each other. First plate member 222 and plate portion 212 fixed using bolt 230 and nut 231 are in surface contact with each other. The head of bolt 230 and washer 232 are provided on a surface of first plate member 222 opposite to its surface facing plate portion 212. Nut 231 is provided on a surface of plate portion 212 opposite to its surface facing first plate member 222. Nut 231 may be integrated with plate portion 212.

Bracket 210 is fixed to right front pillar 5A. First plate member 222 is mounted on bracket 210. First plate member 222 is fixed with respect to right front pillar 5A with bracket 210 interposed therebetween. In a state where first plate member 222 is fixed with respect to right front pillar 5A, the surface of first plate member 222 facing plate portion 212 and the front surface of right front pillar 5A face each other.

Second plate member 223 extends forward with respect to shaft portion 224 in the front-rear direction of cab 5 for the work vehicle. Second plate member 223 extends forward from the support portion which supports shaft portion 224. Second plate member 223 extends toward a direction away from the front surface of cab 5 for the work vehicle, with respect to shaft portion 224.

Second plate member 223 has a through-hole formed to penetrate second plate member 223 in a thickness direction. A bolt 250 is arranged to penetrate this through-hole. Bolt 250 is screwed into a nut 251. A washer 252 is arranged between the head of bolt 250 and second plate member 223.

Nut 251 is arranged inside frame 130 which constitutes the outer edge of front guard 100. Frame 130 is formed of a tubular material, and nut 251 is arranged in a hollow space inside frame 130. Nut 251 may be integrated with frame 130.

An interposition member 240 is interposed between second plate member 223 and frame 130. In the cross sectional view shown in FIG. 4, interposition member 240 has an angulated C shape. Interposition member 240 has a flat plate-like base portion 241 sandwiched between second plate member 223 and frame 130, and protrusion pieces 242, 243 which protrude with respect to base portion 241 and extend perpendicular to a direction in which base portion 241 extends. Interposition member 240 is provided to surround frame 130.

Base portion 241 of interposition member 240 has a through-hole formed to penetrate base portion 241 in a thickness direction. Bolt 250 is arranged to penetrate the through-hole in base portion 241.

Second plate member 223, interposition member 240, and frame 130 are sandwiched between the head of bolt 250 plus washer 252 and nut 251. Thereby, second plate member 223, interposition member 240, and frame 130 are fixed to each other. Second plate member 223 and interposition member 240 fixed using bolt 250 and nut 251 are in surface contact with each other. The head of bolt 250 and washer 252 are provided on a surface of second plate member 223 opposite to its surface facing interposition member 240.

Second plate member 223 is fixed with respect to frame 130 of front guard 100 with interposition member 240 interposed therebetween. Also referring to FIG. 3, hinge 220 is coupled to a right vertical frame extending along right front pillar 5A, of frame 130.

In a state where front guard 100 is closed with respect to cab 5 for the work vehicle as shown in FIG. 4, first plate member 222 and second plate member 223 extend in different directions as viewed in a plan view. In the state where front guard 100 is closed with respect to cab 5 for the work vehicle, first plate member 222 and second plate member 223 intersect with each other to form an acute angle, as viewed in a plan view.

In the state where front guard 100 is closed with respect to cab 5 for the work vehicle, first plate member 222 is arranged to be inclined with respect to the front surface of right front pillar 5A, as viewed in a plan view. When viewed in a plan view, the front surface of right front pillar 5A extends in the left-right direction of cab 5 for the work vehicle, and first plate member 222 extends in a direction intersecting with the left-right direction of cab 5 for the work vehicle. Second plate member 223 extends in the front-rear direction of cab 5 for the work vehicle, as viewed in a plan view.

Figure 5:
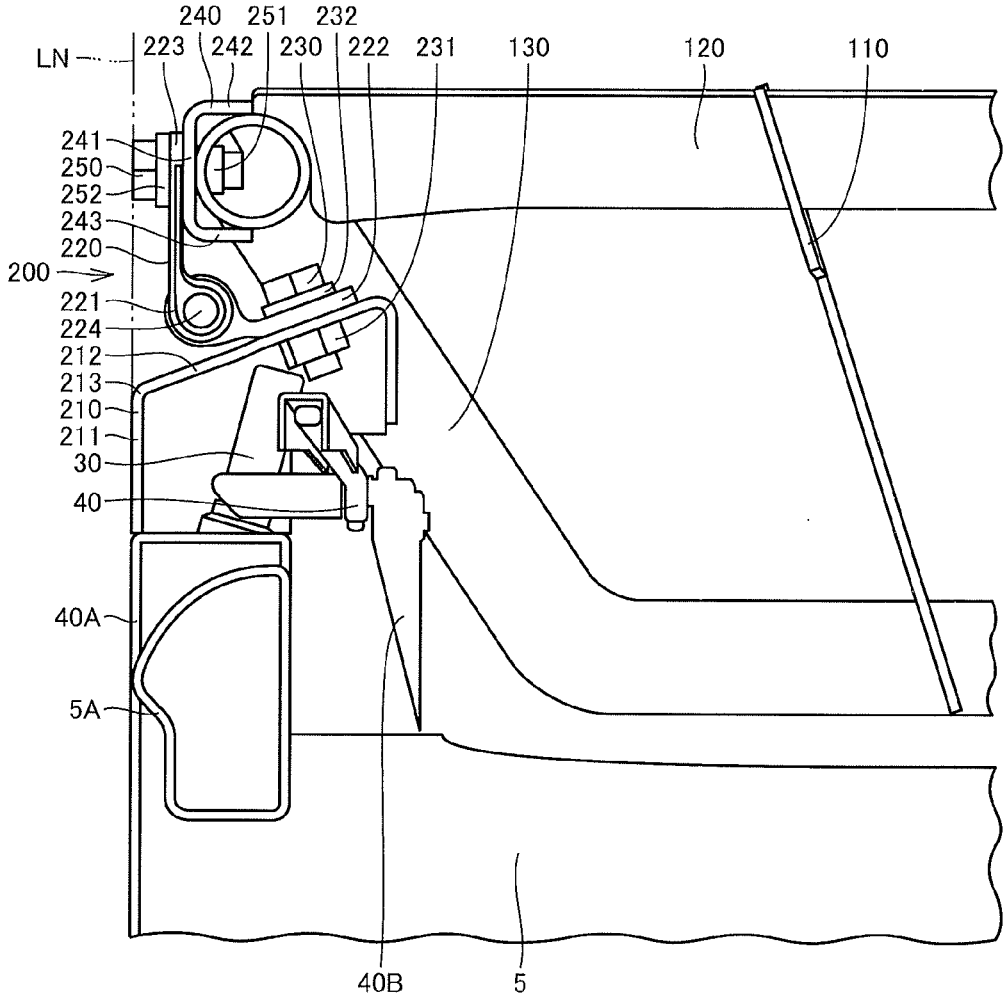
FIG. 5 is a second cross sectional view showing details of the configuration of the coupling portion shown in FIG. 3.

FIG. 5 is a second cross sectional view showing details of the configuration of coupling portion 200 shown in FIG. 3. FIG. 5 shows a cross section of coupling portion 200 taken along the horizontal direction at the position where hinge 220 is arranged, as viewed from below.

A space is formed between plate portion 212 of bracket 210 and right front pillar 5A shown in FIG. 5. A wiper 40 is provided in this space. Wiper 40 has a base portion not shown in FIG. 5, and a blade 40B. Wiper 40 moves in contact with a front surface of front windshield 5W, and blade 40B of wiper 40 wipes front windshield 5W, and thereby front windshield 5W is cleaned. Wiper 40 is included in the cleaning device for cleaning front windshield 5W. Wiper 40 is housed within the space between right front pillar 5A and plate portion 212 of bracket 210. The base portion of wiper 40 is mounted on cleaning device base 40A.

As shown in FIGS. 4 and 5, in the state where front guard 100 is closed with respect to cab 5 for the work vehicle, entire coupling portion 200 is arranged on the left side of chain double-dashed line LN shown in the drawing, in the left-right direction of cab 5 for the work vehicle, as viewed in a plan view. Coupling portion 200 is arranged such that any of the members constituting coupling portion 200 or a portion thereof may not protrude laterally from right surface 5R of cab 5 for the work vehicle. Front guard 100 and coupling portion 200 are arranged so as not to protrude from a right side surface of right front pillar 5A in the left-right direction of cab 5 for the work vehicle.

Figure 6:
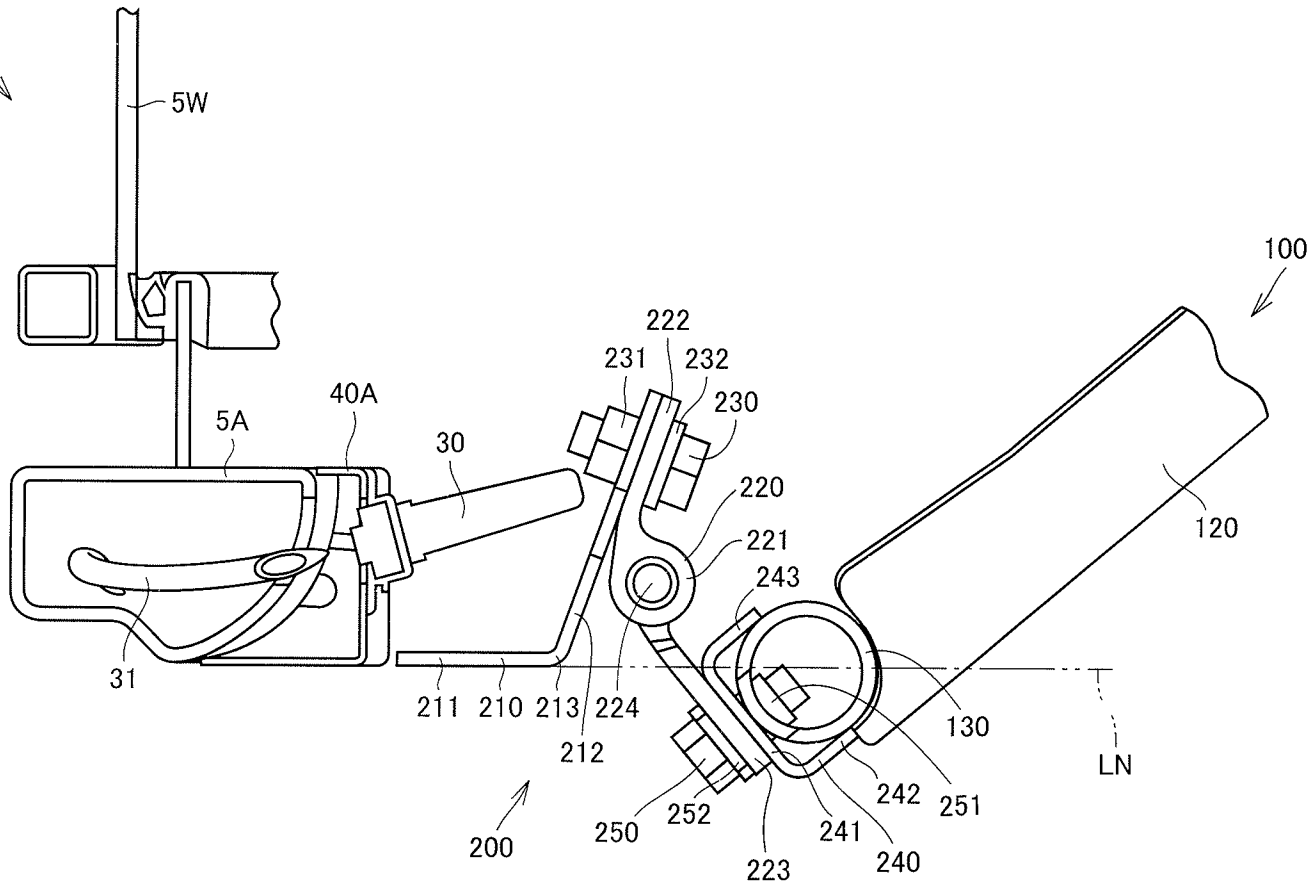
FIG. 6 is a cross sectional view showing a state where the front guard is opened with respect to the cab for the work vehicle.

FIG. 6 is a cross sectional view showing a state where front guard 100 is opened with respect to cab 5 for the work vehicle. FIG. 6 shows front guard 100 in the state opened with respect to cab 5 for the work vehicle, at the cross section shown in FIG. 4.

In the state where front guard 100 is closed with respect to cab 5 for the work vehicle, a left vertical frame of frame 130 of front guard 100 is fixed to the left front pillar of cab 5 for the work vehicle, as shown in FIG. 2. When the left vertical frame of frame 130 is fixed to the left front pillar using bolts as shown in FIG. 2, fixing of the left vertical frame of frame 130 with respect to the left front pillar is cancelled by removing the bolts. Thereby, front guard 100 is openable/closable with respect to the front surface of cab 5 for the work vehicle, about hinges 220.

FIG. 6 shows front guard 100 which rotates clockwise with respect to cab 5 for the work vehicle, about shaft portion 224 of hinge 220. Since front guard 100 is arranged away from the front surface of cab 5 for the work vehicle, the operator can easily access the front surface of cab 5 for the work vehicle. The operator can easily perform maintenance work such as cleaning of front windshield 5W of cab 5 for the work vehicle, by setting front guard 100 in an opened state.

In the state where front guard 100 is closed with respect to cab 5 for the work vehicle as shown in FIG. 4, first plate member 222 and second plate member 223 intersect with each other to form an acute angle, as viewed in a plan view. Second plate member 223 is provided to be relatively rotatable with respect to first plate member 222, about shaft portion 224. Second plate member 223 extends in different directions as viewed in a plan view when front guard 100 is opened with respect to cab 5 for the work vehicle, and when front guard 100 is closed with respect to cab 5 for the work vehicle. In the state where front guard 100 is opened with respect to cab 5 for the work vehicle as shown in FIG. 6, first plate member 222 and second plate member 223 intersect with each other to form an obtuse angle, as viewed in a plan view.

An angle formed by first plate member 222 and the second plate member 223 as viewed in a plan view is larger in FIG. 6 showing the state where front guard 100 is opened with respect to cab 5 for the work vehicle, than that in FIG. 4 showing the state where front guard 100 is closed with respect to cab 5 for the work vehicle.

Next, the function and effect of the present embodiment will be described.

According to the present embodiment, as shown in FIGS. 1 and 2, guard-equipped cab 15 for the work vehicle includes cab 5 for the work vehicle, and front guard 100. As shown in FIGS. 2 and 3, cab 5 for the work vehicle has right surface 5R as one side surface, left surface 5L as another side surface, and right front pillar 5A provided on the side of right surface 5R. Front guard 100 is provided on the front surface of cab 5 for the work vehicle. As shown in FIG. 3, front guard 100 is coupled by hinges 220 to be openable/closable with respect to cab 5 for the work vehicle.

Hinge 220 has shaft portion 224, first plate member 222, and second plate member 223, as shown in FIGS. 4 to 6. First plate member 222 is fixed with respect to right front pillar 5A via bracket 210. First plate member 222 has support portion 221. Shaft portion 224 is supported by support portion 221. First plate member 222 extends from support portion 221 toward left surface 5L of cab 5 for the work vehicle. Second plate member 223 is fixed with respect to frame 130 of front guard 100. Second plate member 223 is formed to relatively rotate with respect to first plate member 222, about shaft portion 224.

Work implement 4 and cab 5 for the work vehicle shown in FIG. 1 are mounted on revolving frame 10. Work implement 4 and cab 5 for the work vehicle may be inclined with respect to revolving frame 10 in the left-right direction. In addition, a portion of a member attached to boom 4*a* of work implement 4, such as a hydraulic pipe, may come closer to cab 5 for the work vehicle, than a set position. Thus, if hinge 220 which couples front guard 100 to cab 5 for the work vehicle protrudes from right surface 5R of cab 5 for the work, vehicle toward work implement 4, a protruding portion may come into contact with work implement 4.

In hinge 220 which couples front guard 100 to cab 5 for the work vehicle, first plate member 222 fixed with respect to right front pillar 5A of cab 5 for the work vehicle extends in a direction from support portion 221 which supports shaft portion 224 toward left surface 5L of cab 5 for the work vehicle. Thus, first plate member 222 constituting hinge 220 can be avoided from being arranged to protrude from right surface 5R of cab 5 for the work vehicle toward work implement 4. Therefore, contact between hinge 220 and work implement 4 can be suppressed.

Further, as shown in FIGS. 4 and 5, in the state where front guard 100 is closed with respect to cab 5 for the work vehicle, the direction in which first plate member 222 extends and the direction in which second plate member 223 extends intersect with each other to form an acute angle, as viewed in a plan view. Second plate member 223 can be avoided from being arranged to protrude from right surface 5R of cab 5 for the work vehicle toward work implement 4, by mounting first plate member 222 to mutually face the front surface of right front pillar 5A, and mounting second plate member 223 such that first plate member 222 and second plate member 223 form an acute angle. Therefore, contact between hinge 220 and work implement 4 can be suppressed.

Further, as shown in FIGS. 4 and 6, an angle formed by first plate member 222 and second plate member 223 in the state where front guard 100 is opened with respect to cab 5 for the work vehicle, as viewed in a plan view, is larger than an angle formed by first plate member 222 and second plate member 223 in the state where front guard 100 is closed with respect to cab 5 for the work vehicle, as viewed in a plan view.

Front guard 100 is set in an opened state when the operator performs maintenance work on front windshield 5W of cab 5 for the work vehicle and the like. While maintenance work is performed, there is no need to take unintended inclination of work implement 4 and cab 5 for the work vehicle in the left-right direction into consideration. Accordingly, maintenance work can be performed with good workability with front guard 100 being set in an opened state, while avoiding contact between hinge 220 and work implement 4.

Further, as shown in FIGS. 4 to 6, guard-equipped cab 15 for the work vehicle includes bracket 210. Bracket 210 is mounted on the front surface of right front pillar 5A. First plate member 222 of hinge 220 is mounted on bracket 210.

Although first plate member 222 of hinge 220 may be directly mounted on the front surface of right front pillar 5A, hinge 220 is arranged apart from the front surface of right front pillar 5A in the front-rear direction by interposing bracket 210 therebetween as in the present embodiment. Thereby, a space can be formed between hinge 220 and right front pillar 5A, and an arbitrary apparatus or member can be housed within this space.

Further, as shown in FIG. 3, guard-equipped cab 15 for the work vehicle includes a plurality of hinges 220. The plurality of hinges 220, 220 are mounted on bracket 210 to be spaced from each other in the direction in which bracket 210 extends. Since both of two hinges 220, 220 arranged to be spaced in the up-down direction is mounted on one bracket 210 extending along right front pillar 5A, the need for adjusting an axis line which serves as the center of rotation when front guard 100 is opened/closed can be eliminated, and manufacturing is facilitated.

Further, as shown in FIGS. 4 to 6, guard-equipped cab 15 for the work vehicle has front windshield 5W, and washer fluid nozzle 30 and wiper 40 for cleaning front windshield 5W. Washer fluid nozzle 30 is housed within the space defined by bracket 210 and right front pillar 5A, as shown in FIGS. 4 and 6. Wiper 40 is housed within the space defined by bracket 210 and right front pillar 5A, as shown in FIG. 5. Thereby, washer fluid nozzle 30 and wiper 40 can be arranged near front windshield 5W, by effectively utilizing a hollow space formed by providing bracket 210.

Further, as shown in FIG. 2, front guard 100 has frame 130 which constitutes the outer edge of front guard 100. Hinge 220 is coupled to the right vertical frame of frame 130, as shown in FIG. 3. Frame 130 is formed of a tubular material. By coupling the right vertical frame of frame 130 to cab 5 for the work vehicle using the structure of hinge 220 in the present embodiment, the right vertical frame of frame 130 can be arranged at a position overlapping with right front pillar 5A as viewed in a front view. Therefore, the function of front guard 100 which protects the operator in cab 5 for the work vehicle can be further improved.

Further, as shown in FIGS. 4 and 5, in the state where front guard 100 is closed with respect to cab 5 for the work vehicle, first plate member 222 is arranged to be inclined with respect to the front surface of right front pillar 5A, and second plate member 223 extends in the front-rear direction of cab 5 for the work vehicle. Thereby, protrusion of hinge 220 from right surface 5R of cab 5 for the work vehicle can be avoided more reliably, and a configuration in which first plate member 222 and second plate member 223 extend to form an acute angle can be easily achieved.

As shown in FIG. 1, hydraulic excavator 1 in the present embodiment includes work implement 4, and guard-equipped cab 15 for the work vehicle described above. Since first plate member 222 constituting hinge 220 can be thereby avoided from being arranged to protrude from right surface 5R of cab 5 for the work vehicle toward work implement 4, contact between hinge 220 and work implement 4 can be suppressed.

Further, as shown in FIG. 1, guard-equipped cab 15 for the work vehicle is arranged on a lateral side of work implement 4, and right front pillar 5A faces work implement 4. Since first plate member 222 constituting hinge 220 can be thereby avoided from being arranged to protrude toward work implement 4 arranged on a lateral side of guard-equipped cab 15 for the work vehicle, contact between hinge 220 and work implement 4 can be reliably suppressed.

It is noted that the embodiment described above has described the example where first plate member 222 has support portion 221, support portion 221 has a cylindrical shape, and shaft portion 224 is housed in support portion 221. The present invention is not limited to this configuration, and support portion 221 of first plate member 222 may be formed to be solid and an end portion of shaft portion 224 in the axis direction may be coupled to support portion 221 of first plate member 222. In this case, second plate member 223 which relatively rotates with respect to first plate member 222 about shaft portion 224 can be easily achieved by forming the support portion of second plate member 223 to have a cylindrical shape, and housing shaft portion 224 inside the support portion of second plate member 223.

Further, the embodiment described above has described front guard 100 in which a grid is formed by the plurality of first plate members 110 and the plurality of second plate members 120, and frame 130 surrounds the grid. Front guard 100 in the embodiment has a high strength, and can satisfy the acceptable standard of level II, of the performance requirements for evaluating characteristics of an operator protective guard defined by ISO (International Organization for Standardization) 10262. The present invention is not limited to this configuration, and the features concerning coupling portion 200 described above may be applied to an operator protective guard which satisfies the acceptable standard of level I defined by ISO 10262. For example, an operator protective guard may be constructed by assembling a screen body to the frame described above.

Furthermore, the embodiment described above has described the example where work implement 4 is arranged on the right side of guard-equipped cab 15 for the work vehicle arranged on the front left side of revolving structure 3 as shown in FIG. 1. The arrangement of guard-equipped cab 15 for the work vehicle and work implement 4 is not limited to the example shown in FIG. 1, and work implement 4 may be provided on the left side of guard-equipped cab 15 for the work vehicle arranged on the front right side of revolving structure 3. In this case, the effect of being able to suppress contact between hinge 220 and work implement 4 can be similarly obtained, if it is configured that the left vertical frame closer to work implement 4, of a pair of vertical frames of frame 130, is coupled to cab 5 for the work vehicle by hinges 220, and first plate member 222 of hinge 220 extends from support portion 221 toward right surface 5R of cab 5 for the work vehicle.

It should be understood that the embodiment disclosed herein is illustrative and non-restrictive in every respect. The scope of the present invention is defined by the scope of the claims, rather than the description above, and is intended to include any modifications within the scope and meaning equivalent to the scope of the claims.

REFERENCE SIGNS LIST

1: hydraulic excavator; 2: travel structure; 3: revolving structure; 4: work implement; 4*a*: boom; 5: cab for work vehicle; 5A: right front pillar; 5L: left surface; 5R: right surface; 5W: front windshield; 10: revolving frame; 15: guard-equipped cab for work vehicle; 30: washer fluid nozzle; 31: washer fluid hose; 40: wiper; 40A: cleaning device base; 40B: blade; 100: front guard; 130: frame; 200: coupling portion; 210: bracket; 211, 212: plate portion; 213: joining portion; 220: hinge; 221: support portion; 222: first plate member; 223: second plate member; 224: shaft portion; 230, 250: bolt; 231, 251: nut; 240: interposition member; 241: base portion; 242, 243: protrusion piece.

The invention claimed is:

1. A guard-equipped cab for a work vehicle, comprising:

a cab in which an operator operating a work vehicle rides, said cab including one side surface, another side surface, and a front pillar provided on a side of said one side surface;

an operator protective guard provided on a front side of said cab; and a hinge which couples said operator protective guard to be openable/closable with respect to said cab, said hinge including a shaft portion, a first plate member which is fixed with respect to said front pillar, includes a support portion supporting said shaft portion, and extends from said support portion toward said other side surface, and a second plate member which is fixed with respect to said operator protective guard, and relatively rotates with respect to said first plate member, about said shaft portion, wherein in a state where said operator protective guard is closed with respect to said cab, said first plate member and said second plate member form an acute angle, as viewed in a plan view, and said second plate member extends in a front-rear direction of said cab and faces an end surface of said operator protective guard.

2. The guard-equipped cab for the work vehicle according to claim 1, wherein an angle formed by said first plate member and said second plate member in a state where said operator protective guard is opened with respect to said cab, as viewed in a plan view, is larger than the angle formed by said first plate member and said second plate member in the state where said operator protective guard is closed with respect to said cab, as viewed in a plan view.

3. The guard-equipped cab for the work vehicle according to claim 1, comprising a bracket mounted on a front surface of said front pillar, wherein said first plate member is mounted on said bracket.

4. The guard-equipped cab for the work vehicle according to claim 3, comprising a plurality of said hinges, wherein said bracket extends along said front pillar, and the plurality of said hinges are mounted on said bracket to be spaced from each other in a direction in which said bracket extends.

5. The guard-equipped cab for the work vehicle according to claim 3, wherein said cab includes a front windshield, and a cleaning device cleaning said front windshield, and at least a portion of said cleaning device is housed within a space defined by said bracket and said front pillar.

6. The guard-equipped cab for the work vehicle according to claim 1, wherein said operator protective guard includes a vertical frame which constitutes an outer edge of said operator protective guard and is coupled to said hinge, and said vertical frame is formed of a tubular material.

7. The guard-equipped cab for the work vehicle according to claim 1, wherein, in the state where said operator protective guard is closed with respect to said cab, said first plate member is arranged to be inclined with respect to a front surface of said front pillar.

8. A hydraulic excavator, comprising:

a work implement; and a guard-equipped cab for a work vehicle as recited in claim 1.

9. The hydraulic excavator according to claim 8, wherein said guard-equipped cab for the work vehicle is arranged on a lateral side of said work implement, and said front pillar faces said work implement.

* * * * *